United States Patent [19]

Shore

[11] 4,422,785

[45] Dec. 27, 1983

[54] RIBBON CARTRIDGE CONSTRUCTION

[76] Inventor: Sydney Shore, 38-04 48 St., Long Island City, N.Y. 11004

[21] Appl. No.: 382,548

[22] Filed: May 26, 1982

[51] Int. Cl.[3] ..... B41J 35/26; B41J 35/28

[52] U.S. Cl. ..... 400/208; 400/247; 29/453

[58] Field of Search ..... 400/247, 713, 536, 537, 400/538, 539, 540, 207, 208, 208.1, 196, 196.1, 195, 194, 191; 29/453

[56] References Cited

U.S. PATENT DOCUMENTS

| | | | |
|---|---|---|---|
| 398,837 | 3/1889 | Loker, Jr. | 400/247 |
| 760,371 | 5/1904 | Baker | 400/247 |
| 1,815,026 | 7/1931 | Green | 400/208 |
| 2,044,072 | 6/1936 | Going | 400/247 X |
| 2,621,539 | 12/1952 | Eustis et al. | 29/453 X |
| 2,718,229 | 9/1955 | Gregory | 29/453 X |
| 3,274,665 | 9/1966 | Higginson et al. | 29/453 X |
| 3,941,231 | 3/1976 | Matuck et al. | 400/196.1 |
| 4,165,188 | 8/1979 | Rempel | 400/248 X |

FOREIGN PATENT DOCUMENTS

| | | | |
|---|---|---|---|
| 55-100183 | 7/1980 | Japan | 400/196.1 |
| 55-133982 | 10/1980 | Japan | 400/689 |

OTHER PUBLICATIONS

Isaacs, "Aligned Underscore Guide", *IBM Technical Disclosure Bulletin,* vol. 11, No. 11, Apr. 1969, p. 1489.

Crowe, . "Foolproof-Insertion, Positive-Position, Operator-Removable Cardholder", IBM Tech. Disc. Bul., vol. 23, No. 10, Mar. 1981, p. 4568.

*Primary Examiner*—Clifford D. Crowder

*Attorney, Agent, or Firm*—Sprung, Horn, Kramer & Woods

[57] ABSTRACT

A ribbon cartridge construction and method of assembling same includes providing a housing with a ribbon access window at the outer perimeter thereof between ribbon inlet and outlet apertures for exposing a run of ribbon for use in printing on an oppositely facing surface and shielding all but a predetermined portion of the exposed ribbon from an oppositely facing surface. The shielding comprises providing a resiliently flexible planar shield including a shielding portion configured to cover the exposed ribbon and having a printing aperture corresponding in size to said predetermined portion of the exposed ribbon and two elongated mounting arms extending outwardly from the shielding portion in opposite directions. One arm is slid longitudinally into one ribbon aperture until fully inserted and is thereby automatically locked in to prevent removal and the other arm is slid longitudinally into the other ribbon aperture to put the shield in its operative position wherein the printing aperture is aligned with the predetermined portion of the ribbon.

8 Claims, 7 Drawing Figures

RIBBON CARTRIDGE CONSTRUCTION

BACKGROUND OF THE INVENTION

The present invention relates to a ribbon cartridge construction and a method of assembling same. In particular the present invention is directed to the shielding of an exposed run of ribbon at the ribbon access window of a ribbon cartridge housing.

Currently, many typewriters, printers and other business machines include printing mechanisms which utilize a ribbon cartridge for the supply of ribbon which has a housing forming a ribbon access window at the outer perimeter thereof for exposing a run of ribbon for printing on an oppositely facing surface. The printing mechanism strikes the exposed run of ribbon from behind at a predetermined portion thereof to effect printing on a oppositely facing surface such as a piece of paper.

Since the requirements for these types of printers is that, in addition to good print quality, they print at high speed, it is necessary that the exposed run of ribbon be extremely close to the printing surface and that the printing mechanism also be close to the exposed run of ribbon so that the total path of travel of a printing element striking the ribbon and, thereafter the printing surface, is small.

It has been found that when the inked surface of the ribbon is disposed close to the printing surface, the relative movement of the printing surface and the ribbon causes smudging and smearing of the ribbon ink on the printing surface. Since this effect is highly undesirable, the art has developed the use of a shield with a printing aperture having the area of the predetermined portion of the exposed ribbon to protect the printing surface from the remaining exposed run of ribbon.

Commercially available shielding has taken many forms. For example, one type of shield is inserted at the ribbon access window through the ribbon inlet and outlet apertures prior to the mounting of the cover on the top of the cartridge. This shield is dropped in from the top and permanently mounted in place by the covering of the cartridge. In an alternative method, the shield is fixed in place on the outside of the cartridge by double sided tape.

The former method of shielding has the disadvantage that it can only be performed by the cartridge manufacturer and the shield cannot be removed or replaced by the user. The latter method has the disadvantage that it is difficult to properly align the shield aperture to the predetermined portion of the exposed ribbon which is struck by the printing mechanism. Moreover, the use of adhesive to fix a shield on the cartridge perimeter is not reliable.

SUMMARY OF THE INVENTION

The main object of the present invention is to provide a ribbon cartridge construction having an improved shield and to provide a method of shielding a ribbon cartridge construction which is simpler and more reliable than that of the prior art.

These and other objects of the present invention are achieved in accordance with the present invention by providing a resiliently flexible planar shield including a shielding portion configured to cover the exposed ribbon and having a printing aperture corresponding in size to the predetermined portion of the exposed ribbon to be struck by the printing mechanism and two elongated mounting arms extending outwardly from the shielding portion in opposite directions. One arm is configured to be slid longitudinally into one ribbon aperture until the shielding portion is in an operative position wherein the printing aperture is aligned with the predetermined portion of the exposed ribbon and the other arm is then slid longitudinally to the other ribbon aperture. The ribbon cartridge housing includes means disposed at the one aperture for operatively engaging means disposed on the one arm of the shield to mechanically lock the arm longitudinally to prevent inadvertent removal and the other arm is slid into the other aperture without restraint such that it would be freely removable.

In a preferred embodiment according to the present invention, the locking mechanism is a one-way locking means which permits the sliding insertion of the one arm into the one ribbon aperture and prevents removal upon insertion of the one arm, a predetermined distance which is slightly less than insertion needed to reach the operative position of the shield, whereby the shield is automatically locked when fully inserted.

The one way locking means advantageously comprises a hole in the one arm and guide means in the housing disposed adjacent to the one ribbon aperture and which forms a guide path receptive of the one arm and a first locking projection in the guide path engageable with the hole. The guide path also preferably includes a second projection which deforms the arm towards the first locking projection to prevent the inadvertent release thereof after locking.

In a particularly advantageous commercial embodiment, the shield comprises an integral plastic member and the hole is a notch along the lower edge of one arm.

The invention will be better understood from the following description taken in conjunction with the accompanying drawings wherein:

DETAILED DESCRIPTION OF THE PREFERRED EMBODIMENTS

Figure 1A:
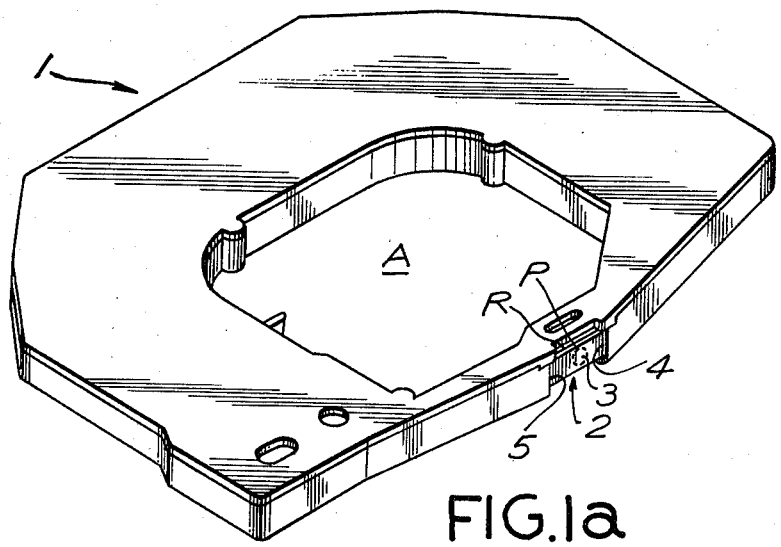
FIG. 1*a* is a perspective view of the ribbon cartridge according to the present invention.

Referring now to FIGS. 1–4, the ribbon cartridge construction according to the present invention relates to an improvement in a ribbon cartridge housing 1 as will be explained hereinafter. While a particular ribbon cartridge housing 1 is shown for the purposes of illustration, it will be understood that the present invention is not limited to this particular ribbon cartridge, but is directed to all ribbon cartridges of the type having means forming a ribbon access window 2 including cartridge edges 2*a*, 2*b*, 2*c* and 2*d* wherein a run of ribbon 3 of ribbon R is left exposed and has a predetermined portion P thereof which is struck from behind by a printing mechanism (now shown) which is situated approximately in area A. The exposed run of ribbon 3 passes between ribbon outlet aperture 5 and ribbon inlet aperture 4 and is wound onto a take-up spool or the like during use of the ribbon cartridge. The exposed run of ribbon 3 has the inked or carbon coated surface thereof facing outwardly towards the printing surface which may be paper or the like and because of the fact that it must be situated so close to the printing surface, there is a tendency for the inked or carbon coated surface to smear or smudge on the printing surface.

Figure 1B:
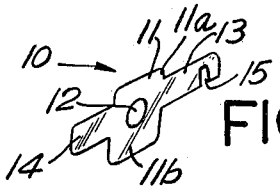
FIG. 1*b* is a perspective view of the shield according to the present invention.

FIG. 1*b* shows the shield according to the present invention for use shielding the exposed run of rubbon 3 from the printing surface during the use of the cartridge. The shield 10 is preferably composed of the resiliently flexible planar member which in a particularly advantageous commercial embodiment comprises 0.005 inch polystyrene and has an integral one piece construction. The shield 10 includes a shielding portion 11 configured to cover the exposed run of ribbon 3 and has a printing aperture 12 corresponding in size to the predetermined portion P of the exposed ribbon and through which printing is effected during use. The shield 10 also includes two elongated mounting arms 13 and 14 extending outwardly from the shielding portion 11 in opposite directions and configured to be slidably received in the ribbon inlet and outlet apertures 4, 5 to dispose the shield in an operative position shown in FIG. 4 wherein the printing aperture 12 is aligned with the predetermined portion P of the exposed ribbon 3.

Figure 4:
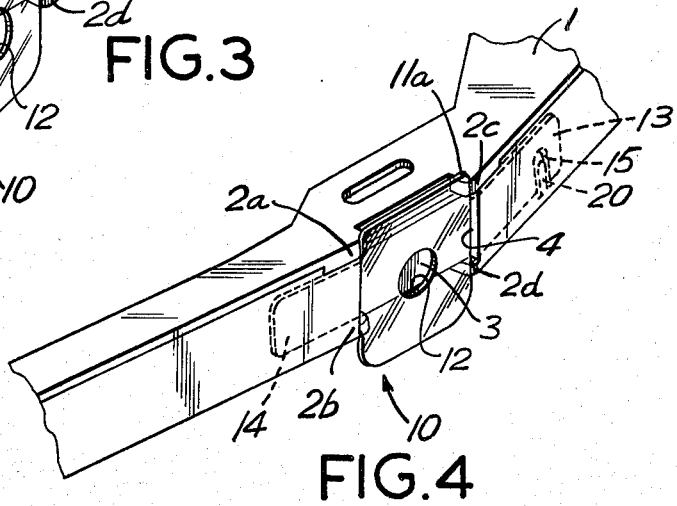
FIG. 4 is a detailed view of a further step according to the method of the present invention.
Figure 5:
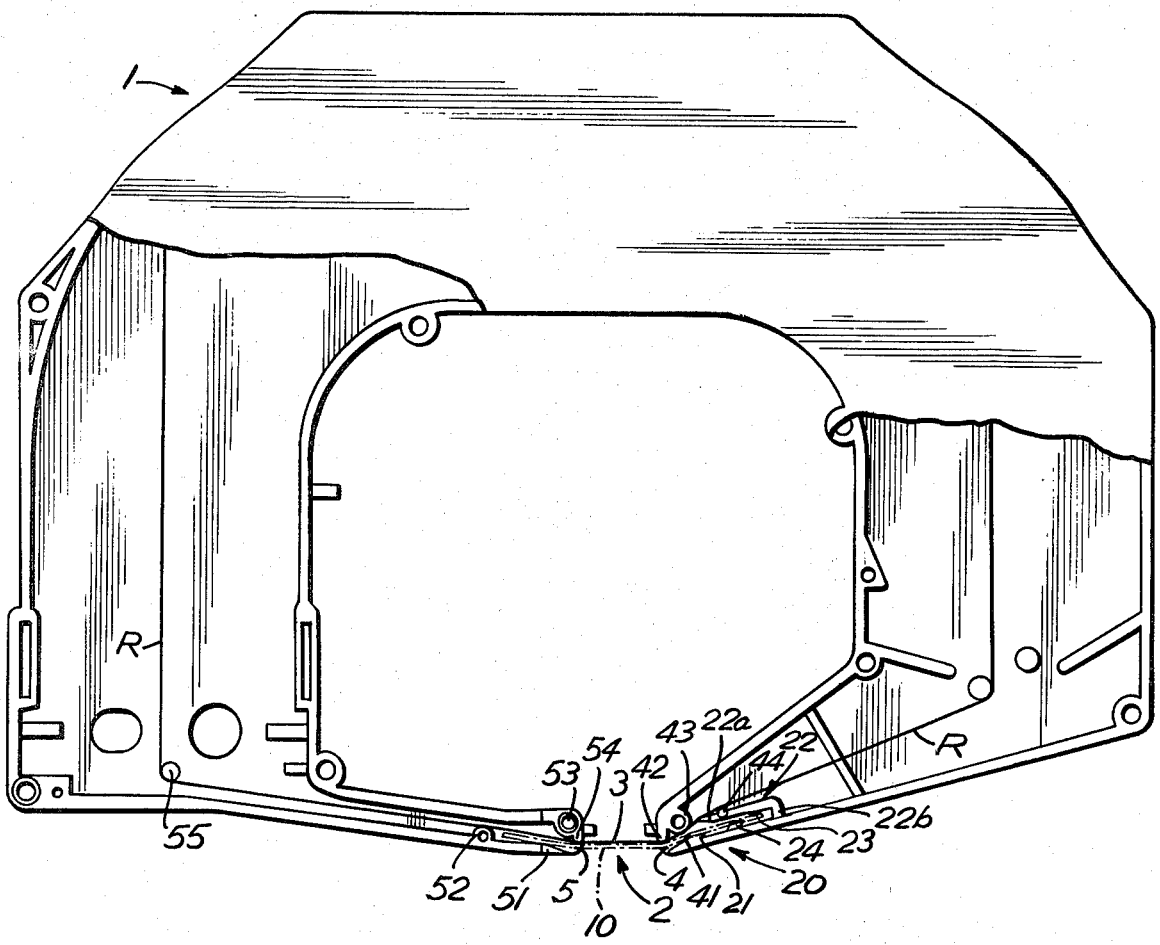
FIG. 5 is a sectional view of the improvement according to the present invention in a ribbon cartridge instruction.

As shown in FIGS. 4 and 5, the ribbon inlet and outlet apertures 4, 5 have a width of 0.030" which is sufficient to receive the mounting arms 13 and 14 outwardly of the ribbon R which also passes through those apertures.

The shielding portion 11 includes portions 11*a* and 11*b* which extend outwardly and downwardly therefrom beyond the width of exposed ribbon 3 and preferably beyond the extent of the ribbon access window 2. The upper portion 11*a* is provided to abut against edges 2*a* and 2*c* of apertures 5 and 4 respectively and lower portion 11*b* is provided to abut against edges 2*b* and 2*d* of apertures 5 and 4 respectively. Additionally, upper portion 11*a* is provided to prevent smudging due to any upward movement of the ribbon during use in a printer and the lower portion 11*b* is provided to smooth out paper, in particular the fan-folded type of paper which has the tendency to buckle outwardly from the printing platen and contact the ribbon to cause undesirable smudging.

The width of the shielding portion 11 is such that when mounted in place as shown in FIG. 4, portions 11*a* and 11*b* abut against edges 2*a*-2*d* to ensure that the shielding portion 11 is in the operative position wherein aperture 12 is aligned with portion P of exposed ribbon 3. Additionally, it is preferable that the width of shielding portion 11 be somewhat larger than the width of the ribbon access window 2 so that the shielding portion will bow out slightly, that it take on a slightly arcuate configuration which has been found to provide better shielding results.

In the embodiments shown, shielding portion 11 has a height of 27/38", a width of $\frac{3}{4}$", with upper portion 11*a* having a height of $\frac{1}{8}$" and portion 11*b* having a height of $\frac{3}{8}$". Printing aperture 12 has a diameter of 5/16", arms 13 and 14 has a height of 11/16, with arm 14 having a length of $\frac{5}{8}$" and arm 13 having a length of 29/32". The notch 15 is situated $\frac{5}{8}$ from the shielding portion 11 and has a width of $\frac{1}{4}$". While the notch is shown to have a circular upper portion, it is clear that the notch may also have a rectangular shape.

Figure 2:
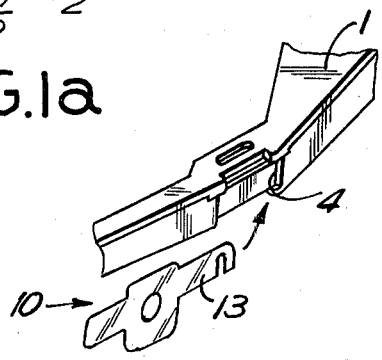
FIG. 2 is a detailed view of one step in the method of shielding according to the present invention.
Figure 3:
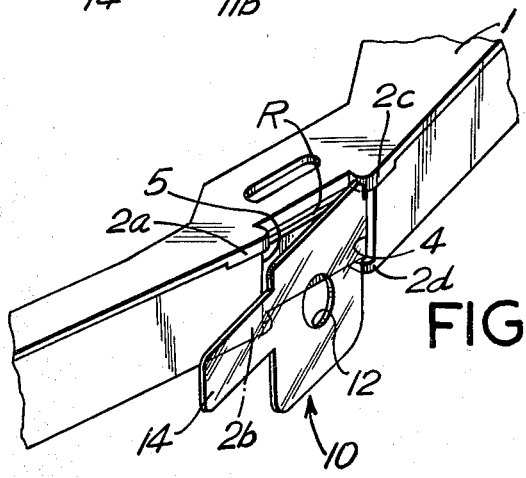
FIG. 3 is a detailed view of a further step according to the method of the present invention.
Figure 6:
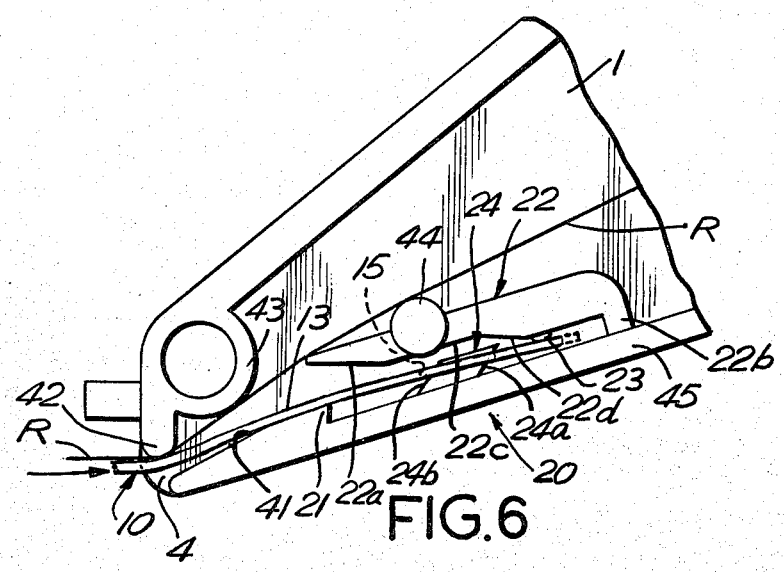
FIG. 6 is a sectional view of a detail of the locking means according to the present invention.

The cartridge construction according to the present invention further comprises one-way locking means 20 shown in more detail in FIGS. 5 and 6 which is disposed on one arm 13 (shown merely by way of example) and adjacent the corresponding one ribbon aperture 4 for permitting the sliding insertion of arm 13 into the aperture 4 as is shown in FIGS. 2 and 3 and for preventing removal of the arm 13 after it has been inserted a predetermined distance which is less than the full insertion needed, as shown in FIGS. 3 and 4 to place the shield portion 11 in the operative position.

With respect to the method of assemblying a ribbon cartridge construction in order to shield exposed ribbon from an oppositely facing surface, the method in accordance with the present invention is illustrated in FIGS. 1–4. In accordance therewith, the step of shielding comprises sliding one arm (arm 13 in the illustrated embodiment) longitudinally, that is along the axis of elongation thereof as shown in FIG. 2 into ribbon aperture 4 until the shielding portions 11*a* and 11*b* abut against the cartridge wall 2*c* and 2*d* above and below aperture 4, as shown in FIG. 3, which places shielding portion 11 in the operative position wherein aperture 12 is aligned with predetermined portion P. Thereafter the other arm 14 is slid longitudinally into aperture 5, as shown in FIG. 4. In the particularly advantageous commercial embodiment in accordance with the present invention, the method of shielding further comprises the automatic mechanical one-way locking of arm 13, when arm 13 is fully inserted as in FIG. 3. The arm 13 will have some play in the longitudinal direction, but cannot be inadvertently removed. The other arm 14 is slid in the ribbon aperture 5 without any additional longitudinal restraint, that is it can be longitudinally removed if desired, although it will not inadvertently slip out due to the locking of arm 13. Arm 13 can be removed if desired by pulling the shield with great force, since the thin plastic material will bend or deform in such a case.

The locking means in accordance with the present invention is shown in more detail in FIGS. 5 and 6.

The locking means 20 comprises a guide path formed by projecting portion 21 which extends inwardly of the cartridge from normally tapered wall 41 of the inlet aperture 4. The other side wall 42 of aperture 4 provides a surface on which the ribbon R rests. Rounded housing members 43 and 44 also define a path for ribbon R.

The guide path for the leading edge of arm 13 includes the projection 21 and a member 22 which includes a leading portion 22*a* which is tapered, a substantially planar portion 22*c*, another tapered portion 22*d* and a rear edge 22*b*. A one-way latching member 24 is provided on the inner side of cartridge side wall 45. Member 22 also includes projection 23 which extends towards side wall 45 beyond the outward extent of latching element 24 so as to ensure that notch 15 and shielding arm 13 will engage with latch member 24 and not inadvertently release.

The guide path and locking mechanism in accordance with the invention operates as follows. As the leading edge of arm 13 is inserted into aperture 4, the edge will be guided along the tapering wall 41 and along projection 21 until it hits tapering wall 22*a* whereby it will be guided along planar portion 22*c* and thereafter surface 22*d*. At this point, the notch 15 has still not engaged with latching member 24. As the arm 13 is further inserted, projection 23 deforms the leading edge of arm 13 towards wall 45 whereby notch 15 will slip over the innermost edge 24*a* of latching member 24. Thus in the position shown in FIG. 6 in solid lines, the arm 13 is now locked in place. In order to reach the operative position of shield 11, the arm 13 must be further inserted a slightly greater distance to the fully inserted position shown in dotted lines in FIG. 6 (and shown in FIG. 3). Therefore, when arm 13 is slid into place directly into the fully inserted position wherein shielding portion 11 is in the operative position, the locking mechanism will automatically engage to prevent inadvertent longitudinal removal. The slanted wall portion 24*b* of latching member 24 ensures that arm 13 can be further inserted after the initial locking by edge 24*a* so that the shielding portion 11*a* can reach the operative position. The projection 23 ensures that even when the arm 13 is moved to the position shown in dotted lines, it will not slip off the latching member 24 and therefore enable the inadvertent removal of the shield 10.

The other arm 14 is merely inserted on the outward side of ribbon R between side wall portions 51 and 54. The ribbon R is supported at the outlet aperture 5 by portions 52, 53 and 55. As can be clearly seen from FIG. 5, the arm 14 is held without restraint so that it can be removed along the longitudinal axis thereof if desired.

While the invention has been particularly shown and described with reference to preferred embodiments thereof, it will be understood by those skilled in the art that various changes in form and details may be made therein without departing from the spirit and scope of the invention.

What is claimed is:

1. In a ribbon cartridge construction having a housing including means forming a ribbon access window at the outer perimeter thereof for exposing a run of ribbon for printing on an oppositely facing surface, a ribbon inlet aperture and a ribbon outlet aperture on either side of the window for the passage of ribbon into and out of the housing and means disposed adjacent said window for shielding all but a predetermined portion of the exposed ribbon from an oppositely facing surface, the improvement wherein: the shielding means comprises a resiliently flexible planar shield including a shielding portion configured to cover the exposed run of ribbon and having a printing aperture corresponding in size to said predetermined portion of the exposed ribbon and first and second elongated mounting arms extending outwardly from the shielding portion in opposite directions and configured to be slidably received in the ribbon inlet and outlet apertures to dispose the shield in an operative position wherein the printing aperture is aligned with the predetermined portion of the exposed ribbon upon the full insertion of both arms; the ribbon inlet and outlet apertures have a width sufficient to receive the mounting arms outwardly of a ribbon passing therethrough; and the cartridge construction further comprises one-way locking means disposed on the first arm and adjacent the corresponding one ribbon aperture for permitting the sliding insertion of said first arm into the one ribbon aperture and for preventing subsequent removal thereof; wherein the one-way locking means comprises a hole in said first arm, guide means disposed adjacent said one ribbon aperture and forming a guide path receptive of said first arm upon insertion in the one ribbon aperture and a first locking projection in the guide path and engageable with said hole.

2. The ribbon cartridge construction according to claim 1, wherein said locking means further comprises a second locking projection in the guide path opposite said first locking projection for deforming the first arm towards the first locking projection to prevent inadvertent release after locking.

3. The ribbon cartridge construction according to claim 2, wherein the means forming the guide path comprises a side wall of the housing and a member adjacent thereto defining a tapering path followed by constricted path in which the first arm is received and wherein the locking projections are disposed in the tapering path and constricted path.

4. The ribbon cartridge construction according to claim 3, wherein the shield portion extends above and below the window.

5. The ribbon cartridge construction according to claim 1, wherein the hole comprises a notch along the lower edge of said first arm.

6. The ribbon cartridge construction according to claim 1 or 5, wherein the shield comprises an integral plastic member.

7. In the method of assembling a ribbon cartridge construction including providing a housing with a ribbon access window at the outer perimeter thereof between ribbon inlet and outlet apertures for exposing a run of ribbon for use in printing on an oppositely facing surface and including shielding all but a predetermined portion of the exposed ribbon from an oppositely facing surface, the improvement wherein the step of shielding comprises providing a resiliently flexible planar shield including a shielding portion configured to cover the exposed ribbon and having a printing aperture corresponding in size to said predetermined portion of the exposed ribbon and first and second elongated mounting arms extending outwardly from the shielding portion in opposite directions; sliding the first arm longitudinally into one ribbon aperture until fully received therein; unidirectionally locking the first arm upon sliding into the one ribbon aperture by providing a hole in the first arm, guiding the first arm along a guide path adjacent the one aperture and engaging the hole with a locking projection in the guide path; and sliding the second arm longitudinally into the other ribbon aperture until it is fully received therein, thereby disposing the shielding portion in an operative position wherein the printing aperture is aligned with said predetermined portion of the exposed ribbon.

8. The method according to claim 7, wherein the step of shielding further comprises sliding the second arm in the other ribbon aperture without restraint.

* * * * *